US005200728A

United States Patent [19]

Patterson et al.

[11] Patent Number: 5,200,728

[45] Date of Patent: Apr. 6, 1993

[54] SOLENOID DEVICE

[76] Inventors: David Patterson, R.R. 190 6, Smith Falls, Ontario K7A 4S7; Albert Patterson, R.R. 190 5, London, Ontario, N6A 4B9 both of Canada

[21] Appl. No.: 890,820

[22] Filed: Jun. 1, 1992

[51] Int. Cl.[5] ..... H01F 7/08

[52] U.S. Cl. ..... 335/223; 335/255; 335/261; 335/256; 335/266; 335/268

[58] Field of Search ..... 335/148-150, 335/222-226, 238, 249, 251, 255-264, 266-268, 270-274, 277-279, 281, 282; 310/22-24, 30, 34, 35

[56] References Cited

U.S. PATENT DOCUMENTS

| | | | |
|---|---|---|---|
| 520,810 | 6/1894 | Thomson . | |
| 1,014,495 | 1/1912 | Lincoln . | |
| 3,305,209 | 2/1967 | Bender et al. . | |
| 3,525,963 | 8/1970 | Burdett | 335/279 |
| 4,086,645 | 4/1978 | Gorman et al. | 335/266 X |
| 4,203,062 | 5/1980 | Bathen | 335/274 X |

*Primary Examiner*—Leo P. Picard
*Assistant Examiner*—Raymond Barrera
*Attorney, Agent, or Firm*—Burke-Robertson

[57] ABSTRACT

An improved solenoid wherein the end of the armature within the first coils has a predetermined length of rigid non-magnetizable material secured to it, and a second, electrically energizable coil being energizable in a manner opposite to that of the first coil, being secured to the other end of the length of non-magnetizable material so as to move therewith from a position adjacent the first coil when the arm is in extended position to one space therefrom when the arm is in retracted position. This coil provides magnetic repulsion between the two coils to produce good starting power for the armature when the first coil is energized, as a result of repulsive magnetic forces created between the two coils.

7 Claims, 1 Drawing Sheet

SOLENOID DEVICE

BACKGROUND OF THE INVENTION

The present invention relates to an improved solenoid. Convention solenoids have an electrically energizable coil consisting of one or more layers of windings about a non-magnetic form producing an electromagnet when the coil is energized, from which form a magnetic armature extends and within which it moves. This armature moves to retracted position when the coil is energized to an extended position under urging from a biasing means when the coil is de-energized. The distance between these positions is known as the "throw" of the solenoid.

Such solenoid devices are widely used for operating circuit breakers, track switches, valves and many other electromechanical devices. They may be used,to operate door locks on cars, in automatic nailer and stapler machines, as electrical motor starters, as contactors on starting equipment, and on fuel racks for diesel engines and the like.

Problems with such conventional solenoids however have limited their applications and usage. For example, with the armature in extended position, because the inner end of the armature is at its position most remote from the corresponding magnetic pole, there is relatively little starting power available to attract the armature into the coil when the coil is energized. As well, the throw is limited by the amount of magnetic strength available when the coil is energized. In practical terms the throw may for instance only be about an inch. In order to overcome these limitations, the number of windings may be increased. Increased windings however result in increased heat being generated when the coil is energized, which heat reduces the ability of the coil to function as an electro magnet and increases wear on the device and components which may surround it.

It is an object of the present invention to provide an improved construction of solenoid which will have increased starting power for the armature, when the coil is energized. It is a further object of the present invention to provide such a solenoid which will permit an increased throw with respect to conventional solenoids. The solenoid according to the present invention provides these advantages without producing the heat build-up which would otherwise be created with additional coil windings. The lower wattage necessary for operation of this solenoid makes it more suitable for feeding with DC power from a battery source than conventional devices.

SUMMARY OF THE INVENTION

In accordance with the invention there is provided a solenoid having an electrically energizable first coil consisting of one or more layers of windings about a non-magnetic form from which a magnetic armature extends and within which the armature moves between retracted and extended position the distance between those positions being the distance of the throw of the solenoid. The end of the armature within the first coil has a section of rigid non-magnetizable material of predetermined length secured to it so as to move therewith. A second, electrically energizable second coil, consisting of one or more layers of windings about a non-magnetic form, which windings are energizable in a manner independent from that of the first coil, is secured to the other end of the length of non-magnetizable material so as to move therewith from a position adjacent the first coil when the armature is in extended position to a position spaced therefrom when the arm is in retracted position. When the first coil is energized to move the armature along its throw, the second coil is simultaneously energized so as to produce a cooperative magnetic force with respect to the first coil.

In a preferred embodiment of the present invention there is provided a solenoid wherein the armature moves to retracted position when the coil is energized and back to extended position under urging from a biasing means when the coil is de-energized. The second coil is energizable in a manner opposite to that of the first coil whereby, when the first coil is energized to move the armature from extended to retracted position by attraction, the second coil is simultaneously energized so as to produce a repulsive magnetic force with respect to the first coil.

The preferred embodiment of the solenoid in accordance with the present invention, as will be described in more detail hereinafter, provides significantly increased starting power for the armature, as a result of the magnetic repulsion between the two coils. This fact also permits the throw to be increased, for example to 2 inches or more, the throw being determined by the length of the non-magnetizable section.

The solenoid according to the present invention, because it permits a greater throw or stroke length, significantly broadens the applications for such solenoid. For example, louvres and dampers can be effectively operated using such solenoids. When the armature is in its final retracted position the second coil can be de-energized by an external switch or points as the holding power of the first coil due to the adjacent location of the retracted armature is full strength.

BRIEF DESCRIPTION OF THE DRAWINGS

These and other objects and advantages of the invention will become apparent upon reading the following detailed description and upon referring to the drawings in which.

While the invention will be described in conjunction with an example embodiment, it will be understood that it is not intended to limit the invention to such embodiment. On the contrary, it is intended to cover all alternatives, modifications and equivalents as may be included with the spirit and scope of the invention as defined by the appended claims.

DETAILED DESCRIPTION OF THE INVENTION

Figure 1:
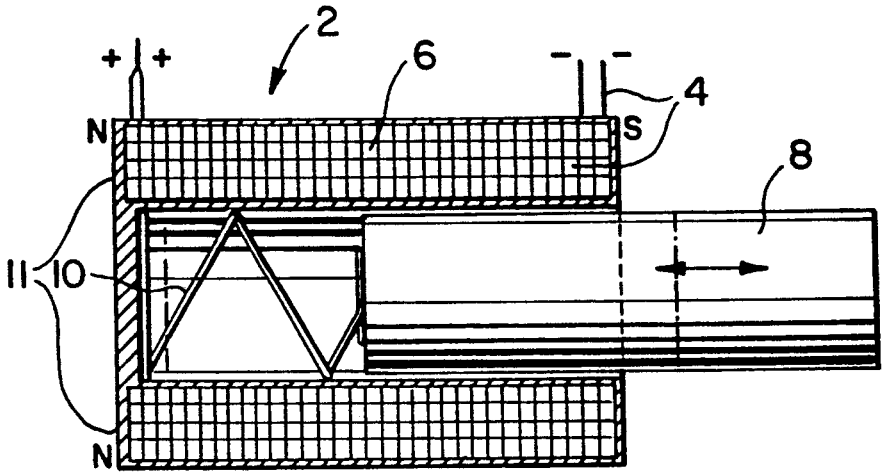
FIG. 1 PRIOR ART
FIG. 1 is a schematic section view of a conventional solenoid as known up to the time of the present invention.

Turning to the drawings, there is illustrated in FIG. 1 a prior art solenoid comprising an electrically energizable coil 2, consisting of one or more layers of windings 4 about a non-magnetic form 6, from which a magnetic armature 8 extends and within which armature 8 moves between a starting, extended position as illustrated, and a retracted position (phantom) when the coil is energized when the coil 2 is energized. A biasing means, which may be a spring 10, for example, urges the retracted armature 8 back to extended position when electrical energy has been removed from coil 2. When coil 2 is energized, that coil and form 6 act as an electro magnet, causing magnetic armature 8 to be drawn into retracted position within form 6. It will be understood that the commencement of the flow of electricity through coil 2, when armature 8 is in the position illustrated in FIG. 1, the magnetic attraction drawing armature 8 into form 6, into retracted position is at its lowest since the inner end of armature 8 is at its most remote location from the corresponding magnetic pole 11, that magnetic attraction increasing to a maximum as armature 8 approaches its retracted position within coil 2 and form 6.

Figure 2:
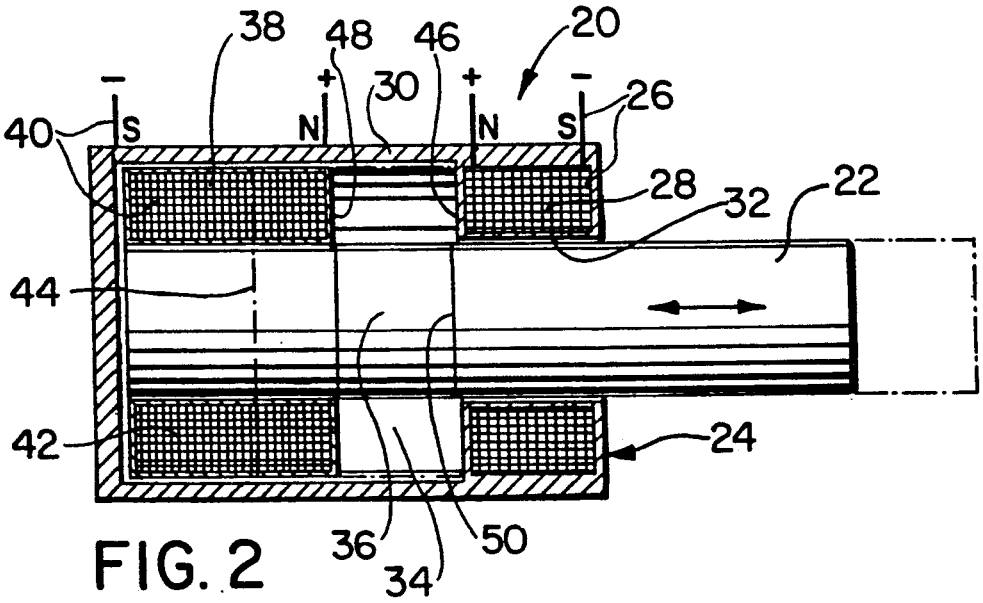
FIG. 2 is a schematic section view of a solenoid in accordance with the present invention.

According to FIG. 2, there is a solenoid 20, in accordance with the present invention, comprising, again, a movable armature 22 made of appropriate magnetic material such as a solid steel, for DC current applications or laminated steel for AC current applications. Armature 22 can have any desired cross-section i.e. round, square, triangular etc. The armature 22 extends into an electrically energizable first coil 24, consisting of windings 26 about a non-magnetic form 28. Form 28 and coil 24 are preferably encased within a housing 30, armature 22 laterally moveable from side to side, with respect to housing 30 within aperture 32.

Aperture 32 extends to a chamber 34 within housing 30. Secured to armature 22 by means of a non-magnetizable section 36, which section is of predetermined longitudinal length, is an electrically energizable second coil 38, which coil again consists of one or more layers of windings 40 about a non-magnetic form 42. In the illustrated embodiment, form 42 and form 28 are both of cylindrical shape, form 42 being wrapped about and secured to a steel core 44. Non-magnetizable section 36 is preferably made of brass or appropriate non-magnetizable metal or ceramic, nylon, etc. Its longitudinal length, as will be understood from the subsequent description of the operation of this device, is determined by the desired distance of movement (throw) of armature 22. As coil 38 and corresponding form 42 must move in conjunction with the movement of armature 22, there must be sufficient space within chamber 34 to permit such movement of coil 38 and form 42.

In the illustrated embodiment, the windings 40 of coil 38 are such that they are energizable in a manner opposite to that of the first coil 24, i.e. when the two coils are energized, confronting faces 46 and 48 are of similar magnetic poles so that there will be strong repulsion between these confronting faces. It is preferred that coils 24 and 38 generate the same amount of magnetic force, so that energy is not wasted during operation of the device. It is also preferred that the core 44 be of a similar cross-sectional dimension to that of armature 22, to make best use of magnetic repulsion between the coils. It will be understood that this repulsive force will be at its strongest when coils 24 and 38 are first energized, in the position illustrated in phantom in FIG. 2, thereby providing significant initial power to commence the retraction of armature 22. As the distance between confronting faces 46 and 48 increases, after simultaneous energization of coils 24 and 38, inner end 50 of armature 22 approaches the inner end of coil 24. As it does so, the attractive forces on that end 50 created by coil 24 increase. Thus, it will be understood that as the repulsive forces between the two coils diminish, the attractive forces of coil 24 on the inner end of armature 22 increase, ensuring that strong initial, as well as strong terminal forces draw armature 22 into retracted position (as illustrated in full line in FIG. 2). Again, any appropriate biasing means, such as a spring (not illustrated), may be provided to force armature 22 and associated coil 38 and form 44 back to its extended position as illustrated in FIG. 2.

It will be understood that, in this manner, significant initial retractive forces are created on armature 22 when coils 24 and 38 are energized, permitting the construction of a solenoids having significantly greater throws than were possible with convention solenoids, until now. Those skilled in the art will appreciate the increased versatility thereby permitted through use of the solenoid according to the present invention. As well, because of the more powerful commencement of retraction of armature 22 permitted by applicant's device, stronger solenoids, using fewer coil windings can be achieved with the subsequent diminution of generation of heat and required wattage.

This versatility will be appreciated by those skilled in the art, for example by realizing that by merely altering the magnetic poles on armature 22 and reversing the flow of current on windings 40 of second coil 38, an effective solenoid can be constructed or in the armature moves from retracted position to extended position when the coils are energized, in this case repulsion between the inner end 50 of armature 22 and the pole located at face 46 of coil 24, on the one hand, and the attraction between coil 24 and coil 38 when the coils are energized, occurring. In this case, the biasing means would be used to force armature 22 and associated coil 38 and form 44 back to retracted position (coil 38 being spaced from coil 24 with chamber 34).

Thus it is apparent that there has been provided in accordance with the invention of improved solenoid that fully satisfies the objects, aims and advantages set forth above. While the invention has been described in conjunction with a specific embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What we claim as our invention is:

1. In a solenoid having an electrically energizable first coil consisting of one or more layers of windings about a non-magnetic form from which a magnetic armature extends and within which said armature moves between retracted position and extended position the distance between those positions being the distance of the throw of the solenoid, the improvement characterized by the end of the armature within the first coil having a section of rigid non-magnetizable material of predetermined length secured to it so as to move therewith, and a second, electrically energizable second coil consisting of one or more layers of windings about a non-magnetic form, which windings are energizable in a manner independent from that of the first coil, said second coil being secured to the other end of the length of non-magnetizable material so as to move therewith from a position adjacent the first coil when the armature is in extended position to a position spaced therefrom when the arm is in retracted position, whereby, when the first coil is energized to move the armature along its throw, the second coil is simultaneously energized so as to produce a cooperative magnetic force with respect to the first coil.

2. A solenoid according to claim 1, wherein the armature moves to retracted position when the coil is energized and back to extended position under urging from a biasing means when the coil is de-energized, and wherein the second coil is energizable in a manner opposite to that of the first coil whereby, when the first coil is energized to move the armature from extended to retracted position, the second coil is simultaneously energized so as to produce a repulsive magnetic force with respect to the first coil.

3. A solenoid according to claim 2, wherein the length of non-magnetizable material is made of brass, ceramic or nylon.

4. A solenoid according to claim 3, wherein the biasing means comprises spring means.

5. A solenoid according to claim 3, wherein the armature is made of solid steel or laminated steel.

6. A solenoid according to claim 5, wherein the non-magnetic form of the second coil circumscribes a steel core.

7. A solenoid according to claim 6, wherein the length of non-magnetizable material has a longitudinal dimension similar to the distance of the throw of the solenoid.

* * * * *